US007975514B2

(12) United States Patent
Kim et al.

(10) Patent No.: US 7,975,514 B2
(45) Date of Patent: Jul. 12, 2011

(54) DRUM TYPE WASHING MACHINE

(75) Inventors: Ja Young Kim, Suwon-si (KR); Ito Michiaki, Suwon-si (KR); Doo Young Ryu, Suwon-si (KR); Myung Sun Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/801,949

(22) Filed: Jul. 2, 2010

(65) Prior Publication Data

US 2010/0269546 A1 Oct. 28, 2010

Related U.S. Application Data

(63) Continuation of application No. 11/802,911, filed on May 25, 2007, now Pat. No. 7,814,769.

(30) Foreign Application Priority Data

Jun. 1, 2006 (KR) ..... 2006-49494
Jun. 1, 2006 (KR) ..... 2006-49497

(51) Int. Cl.
*D06F 35/00* (2006.01)

(52) U.S. Cl. ..... 68/23.1

(58) Field of Classification Search ..... 68/23.1
See application file for complete search history.

(56) References Cited

U.S. PATENT DOCUMENTS 5,850,748 A 12/1998 Kim et al.
6,474,114 B1 11/2002 Ito et al.
2002/0016997 A1 2/2002 Jonsson
2005/0252253 A1 11/2005 Ahn
2006/0016228 A1 1/2006 Chang et al.

FOREIGN PATENT DOCUMENTS

EP 0 806 515 11/1997
KR 20-0136040 12/1997
KR 10-2005-0117004 12/2005

OTHER PUBLICATIONS

U.S. Appl. No. 11/802,911, filed May 25, 2007, Kim et al., Samsung Electronics Co., Ltd.
Office Action dated Apr. 28, 2008 from parent U.S. Appl. No. 11/802,911.
Office Action dated Nov. 7, 2008 from parent U.S. Appl. No. 11/802,911.

(Continued)

*Primary Examiner* — Michael Cleveland
*Assistant Examiner* — Samuel A Waldbaum
(74) *Attorney, Agent, or Firm* — Staas & Halsey LLP

(57) ABSTRACT

A drum type washing machine including a balancer capable of rapidly reducing vibration of a spin tub. The drum type washing machine includes a spin tub which is rotated by receiving rotational force from a driving motor through a rotating shaft, a rear balancer having an annular shape and being coupled to the spin tub, and a shaft flange provided at a center portion thereof with the rotating shaft and coupled to the spin tub so as to uniformly transfer the rotational force to the spin tub. The rear balancer is supported on a rear surface of a rear cover by the shaft flange. Thus, the balls accommodated in the balancer are prevented from moving out of the balancer, even if the balancer is broken due to long-period use.

12 Claims, 6 Drawing Sheets

OTHER PUBLICATIONS

Office Action dated Apr. 23, 2009 from parent U.S. Appl. No. 11/802,911.
Office Action dated Oct. 14, 2009 from parent U.S. Appl. No. 11/802,911.
Office Action dated Feb. 2, 2010 from parent U.S. Appl. No. 11/802,911.
Notice of Allowance dated Jun. 18, 2010 from parent U.S. Appl. No. 11/802,911.
Korean Office Action dated Aug. 18, 2010, issued in Korean Patent Application No. 10-206-0049494.

DRUM TYPE WASHING MACHINE

CROSS-REFERENCE TO RELATED APPLICATIONS

This application is a continuation of U.S. application Ser. No. 11/802,911, filed May 25, 2007, now U.S. Pat. No. 7,814,769 which in turn claims the benefit of Korean Patent Application Nos. 2006-49497 and 2006-49497, both filed on Jun. 1, 2006, in the Korean Intellectual Property Office, the disclosures of which are incorporated herein by reference.

BACKGROUND

1. Field

The present invention relates generally to a drum type washing machine, and more particularly to a drum type washing machine including a balancer capable of rapidly reducing vibration of a spin tub.

2. Description of the Related Art

In general, a drum type washing machine rotates a drum so that the laundry loaded in the drum moves upward and then drops from the top to the bottom of the drum, thereby washing the laundry. The drum type washing machine includes a housing forming an external appearance of the drum type washing machine, a water reservoir accommodated in the housing to receive water therein, a spin tub rotatably installed in the water reservoir, and a driving motor generating rotational force by receiving electric power so as to rotate the spin tub connected to a rotating shaft of the driving motor.

In addition, the drum type washing machine is provided with a shaft flange formed at the center thereof with a rotating shaft and fixed to a rear surface of the spin tub so as to uniformly transfer the rotational force of the driving motor to the rotating shaft, and a balancer fixed to the rear surface of the spin tub so as to rapidly reduce vibration generated when the spin tub is rotated.

The shaft flange includes a hub section for installing the rotating shaft, and a plurality of arm sections extending radially outward from the hub section so as to be fixed to the rotating shaft. The balancer includes a balancer housing formed with an annular race that allows a mass accommodated in the balancer housing to move in the circumferential direction, and a ball movably installed in the annular race so as to serve as the mass. The balancer housing includes first and second balancer housings coupled to each other through fusion welding while forming the race therebetween.

However, according to the balancer having the above structure, the ball accommodated in the balancer housing is subject to centrifugal force during the rotation of spin tub, so the ball repeatedly collides with the first and second balancer housings. If the ball applies such impact to the first and second balancer housings for a long period of time, the connection part between the first and second balancer housings is weakened, so that the first balancer housing is separated from the second housing. In this case, the ball accommodated in the race of the balancer housing may move out of the race.

SUMMARY

Additional aspects and/or advantages of the invention will be set forth in part in the description which follows and, in part, will be apparent from the description, or may be learned by practice of the invention.

Accordingly, the present invention has been made to solve above-mentioned problems occurring in the prior art, and an aspect of the present invention is to provide a drum type washing machine capable of preventing a ball accommodated in a balancer from moving out of the balancer, even if the balancer is broken due to long-period use of the balancer.

In order to accomplish this aspect, the present invention provides a drum type washing machine including a spin tub which is rotated by receiving rotational force from a driving motor through a rotating shaft, a rear balancer having an annular shape and being coupled to the spin tub, and a shaft flange provided at a center portion thereof with the rotating shaft and coupled to the spin tub so as to uniformly transfer the rotational force to the spin tub, wherein the rear balancer is supported on a rear surface of a rear cover by means of the shaft flange.

The spin tub includes a spin tub body having a cylindrical shape and a rear surface of which is opened, and the rear cover covering the rear surface of the spin tub body, a part of a rear end portion of the spin tub body protrudes toward a rear side of the rear cover, and an outer end portion of the shaft flange is fixed to the part of the rear end portion of the spin tub body that protrudes toward the rear side of the rear cover.

A support section is provided at an outer peripheral end portion of the rear cover, in which the support section extends rearward in parallel to the spin tub body such that an outer peripheral surface of the rear balancer is supported by the support section and an outer peripheral end portion of the shaft flange is fixed to the support section.

An annular groove is formed at the outer peripheral end portion of the rear cover so as to receive the rear balancer, and the rear balancer is rested in the annular groove by means of the shaft flange.

The rear balancer includes first and second balancer housings having annular shapes and being coupled to each other such that a race, in which a plurality of balls are movably installed, is formed between the first and second balancer housings.

The present invention also provides a drum type washing machine including a spin tub which is rotated by receiving rotational force from a driving motor through a rotating shaft, a rear balancer having an annular shape and reducing vibration of the spin tub, and a shaft flange provided at a center portion thereof with the rotating shaft and coupled to the spin tub so as to uniformly transfer the rotational force to the spin tub, wherein the rear balancer is installed on the shaft flange.

The shaft flange includes a balancer support on which the rear balancer is installed.

The balancer support is formed with a groove in which the rear balancer is rested, and the groove is opened toward a rear surface of the spin tub.

The shaft flange includes a hub section for installing the rotating shaft, and a plurality of arm sections extending radially outward from the hub section so as to be fixed to the spin tub, in which the balancer support extends from end portions of the arm sections.

The balancer support has an annular shape and is connected to the arm sections.

The rear balancer includes first and second balancer housings having annular shapes and are coupled to each other such that a race, in which a plurality of balls are movably installed, is formed between the first and second balancer housings.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EMBODIMENTS

Figure 1:
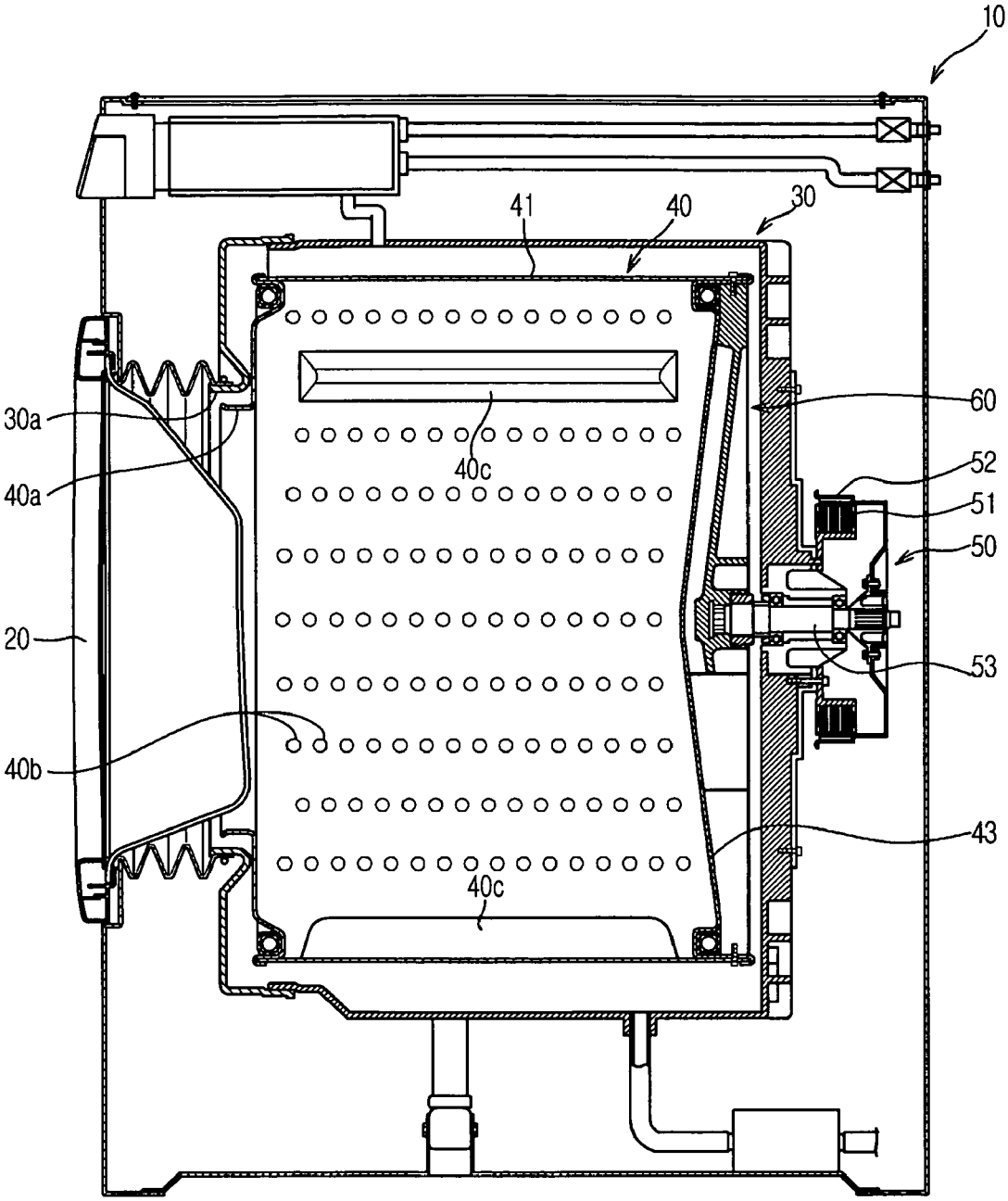
FIG. 1 is a sectional view showing the structure of a drum type washing machine according to a first embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, a drum type washing machine according to a first embodiment of the present invention will be described with reference to accompanying drawings.

As shown in FIG. 1, the drum type washing machine according to the present invention includes a housing 10 having a box shape forming an external appearance of the drum type washing machine, a water reservoir 30 accommodated in the housing 10 to receive water therein, a spin tub 40 rotatably installed in the water reservoir 30 and having a cylindrical structure formed with a plurality of pores 40*b* allowing water and air to pass through the spin tub 40, and a driving motor 50 transferring power to the spin tub 40 so as to rotate the spin tub 40 such that the laundry contained in the spin tub 40 can be washed and dehydrated.

Openings 30*a* and 40*a* are formed at front center portions of the water reservoir 30 and the spin tub 40 so as to allow the user to put the laundry into the spin tub 40 or to take out the laundry from the spin tub 40. A door 20 is hinged to the front surface of the housing 10 so as to open/close the openings 30*a* and 40*a* of the water reservoir 30 and the spin tub 40. Lifters 40*c* are provided on the inner peripheral wall of the spin tub 40 at a predetermined interval. As the spin tub 40 rotates in the forward and reverse directions, the laundry placed in the spin tub 40 is moved upward and then dropped downward in the spin tub 40 by means of the lifters 40*c*, so that the laundry is washed.

The spin tub 40 includes a spin tub body 41 having a cylindrical shape and being installed lengthwise along the spin tub 40, in which front and rear surfaces of the spin tub body 41 are opened, and covers 42 and 43 covering the front and rear surfaces of the spin tub body 41. The covers 42 and 43 include a front cover 42 (see FIG. 2) covering the front surface of the spin tub 40 and being formed at the center thereof with the opening 40*a* so as to allow the user to put the laundry into the spin tub 40, and a rear cover 43 covering the rear surface of the spin tub 40 and being provided at the center thereof with a rotating shaft 53 that transfers driving force of the driving motor 50.

The driving motor 50 includes a stator unit 51 fixed to the rear surface of the water reservoir 30, a rotor unit 52 rotatably installed around the stator unit 51, and a rotating shaft 53 having a first end installed at the rotor unit 52 and a second end installed at the rear cover 43 forming the rear surface of the spin tub 40 by passing through the water reservoir 30.

In addition, a shaft flange 60 provided at the center thereof with the rotating shaft 53 is fixed to the rear surface of the spin tub 40 so as to uniformly transfer the rotational force of the driving motor 50 to the spin tub 40, so that the spin tub 40 is rotated by receiving the rotational force of the driving motor 50 through the shaft flange 60.

Figure 2:
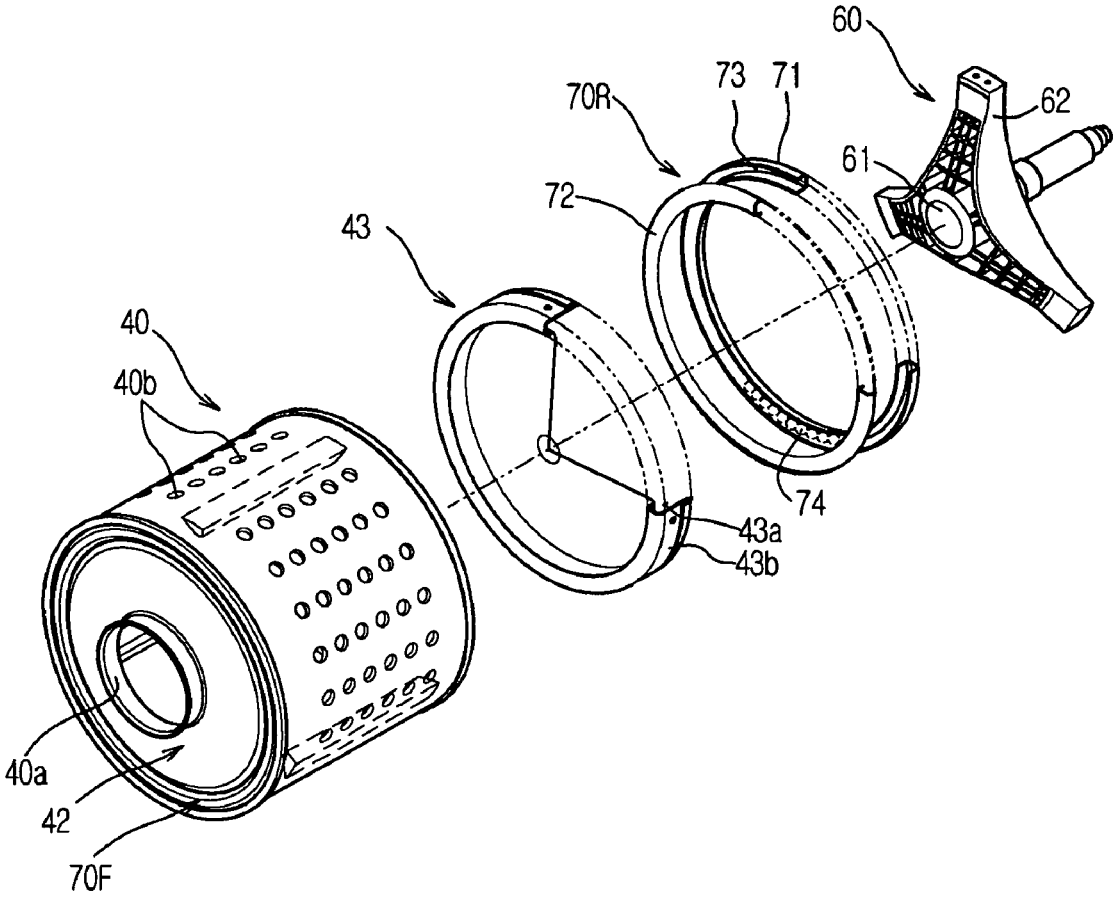
FIG. 2 is an exploded perspective view showing the arrangement of a balancer and a shaft flange provided in a drum type washing machine according to a first embodiment of the present invention.

The shaft flange 60 uniformly transfers the rotational force of the driving motor to various portions of the spin tub 40, thereby preventing excessive force from being transferred to a specific part of the spin tub 40. As shown in FIG. 2, the shaft flange 60 includes a hub section 61 for fixedly installing the rotating shaft 53, and a plurality of arm sections 62 extending radially outward from the hub section 61 so as to be fixed to the outer peripheral end portion of the spin tub 40 while being spaced apart from each other in the circumferential direction at a predetermined interval. According to the present embodiment, the shaft flange 60 has three arm sections 62. The rotational force of the driving motor 50 is uniformly transferred to three spots of the outer peripheral end portion of the spin tub 40 through the three arm sections 62.

In addition, the front and rear covers 42 and 43 that form the front and rear surfaces of the spin tub 40 are provided with balancers 70F and 70R, respectively. The balancers 70F and 70R rapidly reduce vibration of the spin tub 40, which is generated during the rotation of the spin tub due to unbalance of the laundry placed in the spin tub, thereby stabilizing the rotation of the spin tub 40 in the early stage. In the present embodiment, the balancer 70F installed at the front side of the spin tub 40 is referred to as a front balancer 70F and the balancer 70R installed at the rear side, of the spin tub 40 is referred to as a rear balancer 70R.

A mass is installed in the balancers 70F and 70R in such a manner that the mass can move in the circumferential direction of the balancers 70F and 70R. If the unbalance occurs due to the weight of laundry placed in the spin tub 40, the mass accommodated in the balancers 70F and 70R moves in the circumferential direction so as to compensate for the unbalance. Thus, the vibration of the spin tub 40 caused by the unbalance mass can be rapidly reduced.

The rear balancer 70R installed at the rear cover 43 includes first and second balancer housings 71 and 72 having an annular shape and being coupled with each other such that a race 73, which is a moving route of the mass, can be formed therebetween, and a plurality of balls 74 is movably installed in the race 73 so as to serve as the mass. The first balancer housing 71 may be coupled with the second balancer housing 72 through fusion welding, etc.

According to the drum type washing machine of the present invention, at least a part of the rear balancer 70R is supported on the rear surface of the rear cover 43 by means of the shaft flange 60, so that the front and rear surfaces of the rear balancer 70R are supported on the rear surface of the rear cover 43 and the front surface of the arm section 62 of the shaft flange 60, respectively. Thus, even if the connection part between the first and second balancer housings 71 and 72 is broken due to long-period use, the first and second balancer housings 71 and 72 can be secured to each other. Since the first balancer housing 71 can be secured to the second balancer housing 72, the balls 74 installed in the rear balancer 70R can be prevented from moving out of the rear balancer 70R. According to the present embodiment, the shaft flange 60 includes three arm sections 62, so at least three spots of the rear balancer 70R are supported by means of the three arm sections 62.

Figure 3:
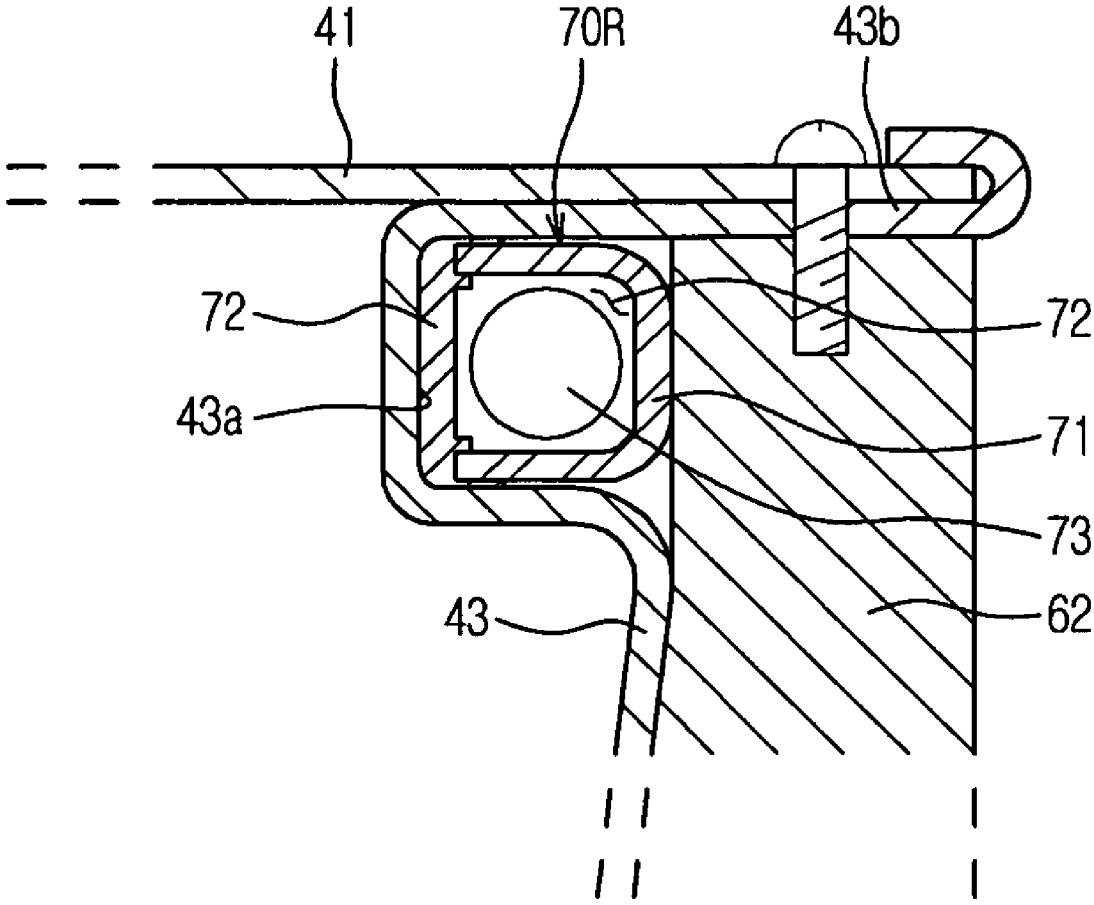
FIG. 3 is a sectional view showing the arrangement of a balancer and a shaft flange provided in a drum type washing machine according to a first embodiment of the present invention.

In addition, in order to allow the rear balancer 70R to be supported by the rear surface of the rear cover 43 and the front surface of the arm section 62 of the shaft flange 60, a groove 43*a* is formed in the rear cover 43. The groove 43*a* has an annular shape corresponding to the shape of the rear balancer 70R such that the rear balancer 70R can be rested in the groove 43*a*. In addition, a part of the rear end portion of the spin tub body 41 protrudes toward the rear side of the rear cover 43, so that the end portion of the arm section 62 of the shaft flange 60 is fixed to the protruding part of the rear end portion of the spin tub body 41, as shown in FIG. 3. Accordingly, the rear balancer 70R can be stably installed in the groove 43*a* by means of the arm section 62 of the shaft flange 60.

According to the present embodiment, a supporter 43*b* is provided at the outer peripheral end portion of the rear cover 43. The supporter 43*b* extends in the rear direction in parallel to the spin tub body 41 and the outer peripheral surface of the rear balancer 70R is supported on the inner surface of the supporter 43*b* and the end portion of the arm section 62 is fixed to the inner surface of the supporter 43*b*.

Figure 4:
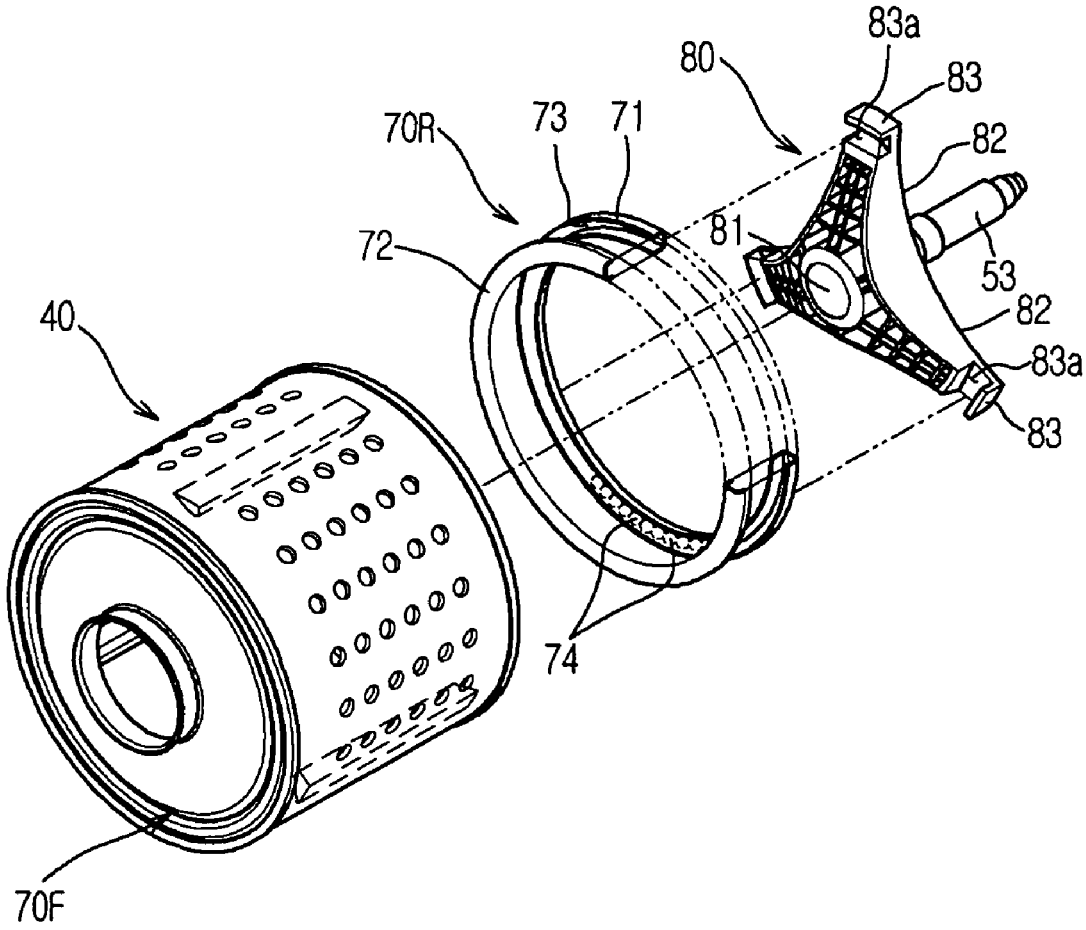
FIG. 4 is an exploded perspective view showing the arrangement of a balancer and a shaft flange provided in a drum type washing machine according to a second embodiment of the present invention.

FIG. 4 is an exploded perspective view showing the arrangement of a rear balancer 70R and a shaft flange 80 provided in a drum type washing machine according to a second embodiment of the present invention.

The rear balancer 70R applied to the drum type washing machine according to a second embodiment of the present invention includes first and second balancer housings 71 and 72 having an annular shape and being coupled with each other such that a race 73, which is a moving route of the mass, can be formed therebetween, and a plurality of balls 74 movably installed in the race 73 so as to serve as the mass. The shaft flange 80 includes a hub section 81 for installing the rotating shaft 53, and a plurality of arm sections 82 extending radially outward from the hub section 81 while being spaced apart from each other in the circumferential direction at a predetermined interval.

In addition, at least a part of the first and second balancer housings 71 and 72 constituting the rear balancer 70R is installed on the shaft flange 80 such that the first and second balancer housings 71 and 72 are supported against each other. Thus, even if the connection part between the first and second balancer housings 71 and 72 is weakened due to long-period use, the first and second balancer housings 71 and 72 can be secured to each other, thereby preventing the balls 74 installed in the race 73 from moving out of the race 73.

To this end, balancer supports 83, which are opened toward the rear surface of the spin tub 40 so as to support the rear balancer 70R installed thereon, are provided at outer end portions of the shaft flange 80. The balancer supports 83 extend from end portions of the arm sections 82 of the shaft flange 80 and are formed with mounting grooves 83*a* which are opened toward the rear surface of the spin tub 40 so as to mount the rear balancer 70R thereon. In addition, end portions of the balancer supports 83 are fixed to the spin tub 40 by means of a coupling member, such as a bolt, so that the shaft flange 80 can be fixed to the spin tub 40 through the balancer supports 83.

Figure 5:
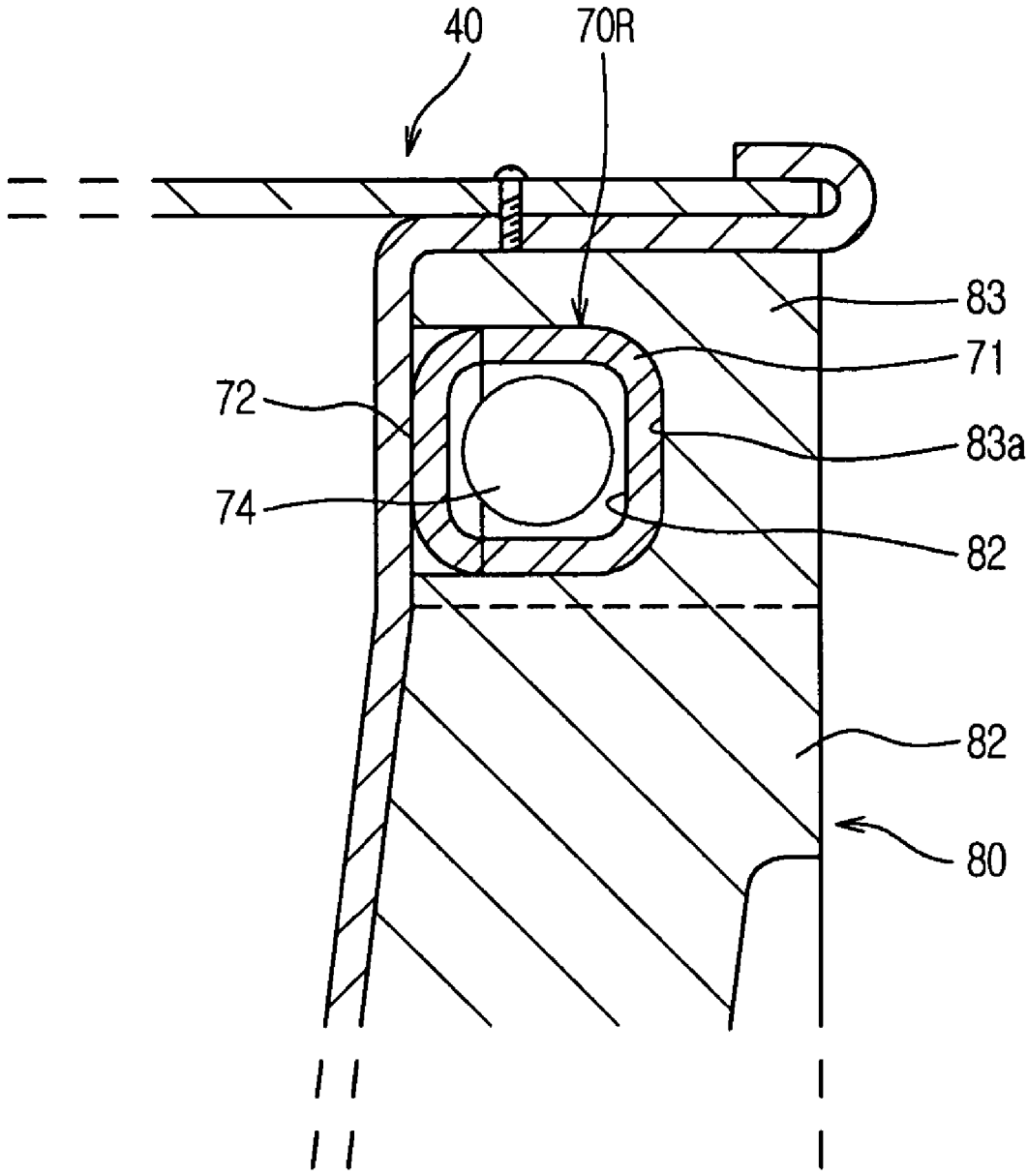
FIG. 5 is a sectional view showing the arrangement of a balancer and a shaft flange provided in a drum type washing machine according to a second embodiment of the present invention.

According to the present embodiment, the shaft flange 80 includes three arm sections 62 and three balancer supports 83 extend from end portions of three arm sections 62. Thus, as shown in FIG. 5, parts of three spots of the rear balancer 70R are rested in the mounting grooves 83*a* formed in three arm sections 82, respectively. Therefore, since the parts of three spots of the rear balancer 70R are rested in the mounting grooves 83*a*, the front, rear, outer peripheral and inner peripheral surfaces of the rear balancer 70R are supported by the rear surface of the spin tub 40 and the inner surfaces of the mounting grooves of the shaft flange 80. Accordingly, even if the connection part between the first and second balancer housings 71 and 72 is broken due to long-period use, the first and second balancer housings 71 and 72 can be secured to each other, thereby preventing the balls 74 from moving out of the race 73.

In this manner, if the rear balancer 70R is installed in on the shaft flange provided with the rotating shaft 53 through the mounting grooves 83*a*, the rotational center of the rear balancer 70R precisely matches with the rotational center of the rotating shaft 53. Accordingly, there is no need to perform precision work for matching the rotational center of the rear balancer 70R with the rotational center of the rotating shaft 53, so that assembly work for the drum type washing machine can be simplified.

Figure 6:
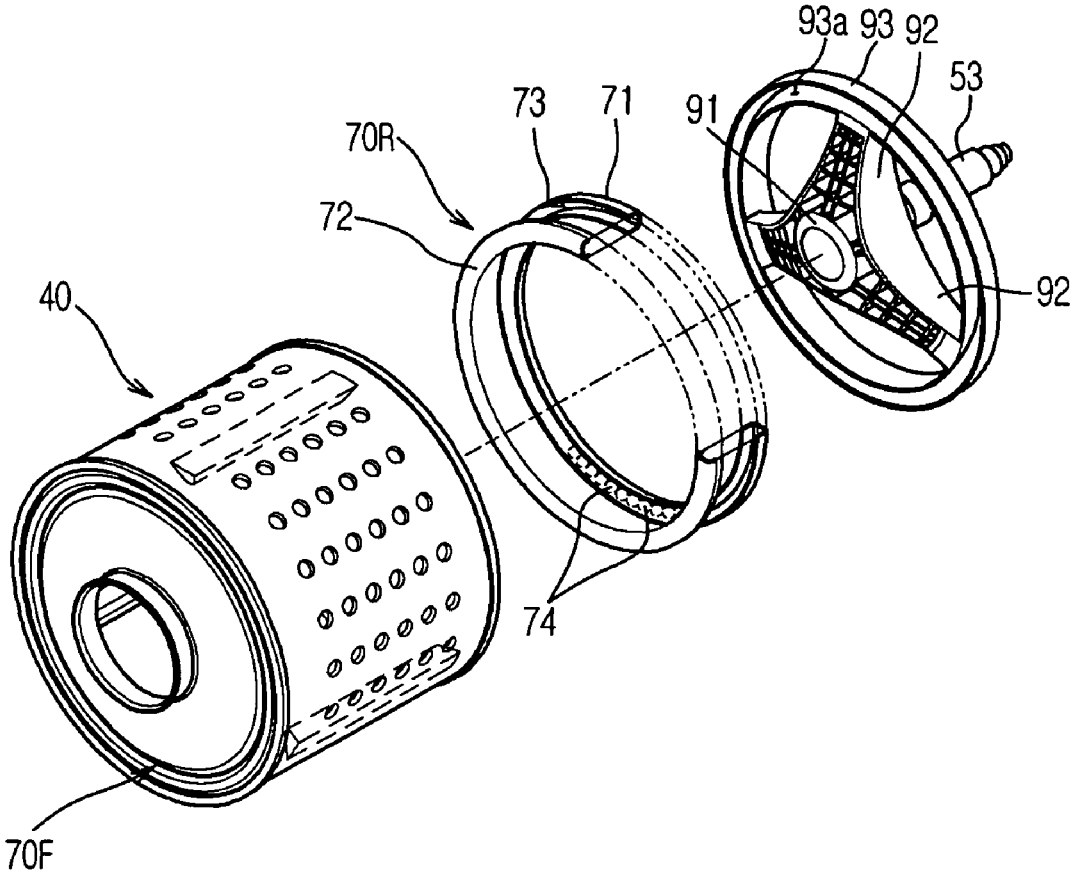
FIG. 6 is an exploded perspective view showing the arrangement of a balancer and a shaft flange provided in a drum type washing machine according to a third embodiment of the present invention.

FIG. 6 is an exploded perspective view showing the arrangement of a balancer and a shaft flange provided in a drum type washing machine according to a third embodiment of the present invention.

As shown in FIG. 6, the shaft flange 90 provided in the drum type washing machine according to the third embodiment of the present invention includes a hub section 91 for installing the rotating shaft 53, a plurality of arm sections 92 extending radially outward from the hub section 91 while being spaced apart from each other in the circumferential direction, and a balancer support 93 extending in the circumferential direction while connecting outer end portions of the arm sections 92 to each other such that the rear balancer 70R can be installed on the balancer support 93. The balancer support 93 is formed with an annular groove 93*a* which is opened toward the rear surface of the spin tub 40.

Since the annular groove 93*a* is formed in the balancer support 93 for mounting the rear balancer 70R, the front, rear, outer peripheral and inner peripheral surfaces of the rear balancer 70R are wholly supported by the rear surface of the spin tub 40 and the inner surface of the annular groove 93*a*. Accordingly, even if the connection part between the first and second balancer housings 71 and 72 is broken, the first and second balancer housings 71 and 72 can be secured to each other, thereby preventing the balls 74 from moving out of the race 73. In addition, impact caused by collision of balls 74 is partially transferred to the balancer support 93, so that impact applied to the first and second balancer housings 71 and 72 can be reduced. Thus, the connection part between the first and second balancer housings 71 and 72 can be protected from breakage.

As described above, according to the drum type washing machine of the present invention, since the balancer is supported on the rear surface of the spin tub by means of the shaft flange, the balls accommodated in the balancer can be prevented from moving out of the balancer, even if the balancer is broken due to long-period use.

In addition, according to the drum type washing machine of the present invention, the balancer is mounted on the shaft flange provided at the center thereof with the rotating shaft, so that the rotational center of the balancer can be easily matched with the rotational center of the rotating shaft.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A drum type washing machine comprising:

a housing forming an external appearance of the drum type washing machine;

a water reservoir accommodated in the housing to receive water therein;

a spin tub disposed in the water reservoir, which is rotated by receiving rotational force from a driving motor through a rotating shaft, the spin tub including a spin tub body having a cylindrical structure formed with a plurality of pores allowing water and air to pass through the spin tub, the spin tub body having a front cover with a laundry receiving opening provided at a front side thereof and a rear cover provided at a rear side thereof;

a rear balancer comprising a first housing section and a second housing section joined together to form an annular shaped race and a plurality of balls movably installed in the annular shaped race, the rear balancer coupled to the rear cover of the spin tub to reduce vibration of the spin tub during rotation thereof; and a shaft flange including a hub section to fixedly install the rotating shaft and a plurality of arm sections extending radially outward from the hub section and mounted to the spin tub so as to uniformly transfer the rotational force to the spin tub, wherein the rear balancer is disposed in an annular groove formed in the rear cover of the spin tub and becomes sandwiched between the rear cover and the arm sections of the shaft flange when an outer end portion of each respective arm section of the shaft flange is fixedly connected to a rear end portion of the spin tub body, the first housing section of the rear balancer has an open side, first and second walls facing each other and a third wall formed between the first and second walls, the second housing section of the rear balancer is adapted to cover the open side of the first housing section, and the rear balancer is disposed in the annular groove such that the second housing section covering the open side of the first housing section is disposed at an innermost portion of the annular groove formed in the rear cover of the spin tub.

2. The drum type washing machine of claim 1, wherein a supporter is provided at an outer peripheral end portion of the rear cover, wherein an end portion of each respective arm section of the shaft flange is fixed to a protruding part of the rear end portion of the spin tub body and the supporter to secure the rear balancer, wherein a fastener is used to fixedly fasten the protruding part of the rear end portion of the spin tub body and the supporter of the rear cover to the end portion of each respective arm section of the shaft flange.

3. The drum type washing machine of claim 2, wherein the portion of the rear cover comprises a support section provided at an outer peripheral end portion of the rear cover that extends rearward in parallel to the spin tub body.

4. The drum type washing machine of claim 3, wherein the outer end portion of each respective arm section is fixed to the support section of the rear cover.

5. The drum type washing machine of claim 1, wherein the depth of the annular groove formed in the rear cover is sized such that, when the rear balancer is sandwiched between the rear cover and the arm sections, a rear surface of the rear balancer does not extend beyond a hollow space region defined by the annular groove, enabling the arm sections to support the rear balancer without having to form recesses in portions of the arm sections that engage the rear balance.

6. The drum type washing machine of claim 1, wherein the first housing sections and the second housing section of the rear balancer are joined together through fusion welding.

7. A drum type washing machine comprising:

a housing;

a water reservoir accommodated in the housing to receive water therein;

a spin tub disposed in the water reservoir, the spin tub rotatable by receiving rotational force from a driving motor through a rotating shaft, the spin tub including a spin tub body having an opening formed at a front side thereof to receive laundry and a rear cover provided at a rear side thereof;

a rear balancer having an annular shaped race and a plurality of balls movably installed in the race, and the rear balancer being coupled to the rear cover of the spin tub to reduce vibration of the spin tub during rotation thereof; and a shaft flange to uniformly transfer the rotational force to the spin tub, the shaft flange including a hub section for fixedly installing the rotating shaft and a plurality of arm sections extending radially outward from the hub section, wherein the arm sections are fixedly mounted to the spin tub so as to sandwich the rear balancer between the rear cover of the spin tub and the shaft flange, wherein the annular groove formed in the rear cover is sized such that the balls installed in the race of the rear balancer are completely disposed within the annular groove, the rear balancer comprises a first housing section and a second housing section coupled with each other such that the annular shaped race is formed therebetween and the plurality of balls are movably installed in the race so as to serve as a balancing mass, the first housing section has an open side, first and second walls facing each other and a third wall formed between the first and second walls, the second housing section is adapted to cover the open side of the first housing section, and the rear balancer is disposed in the annular groove such that the second housing section covering the open side of the first housing section is disposed at an innermost portion of the annular groove formed in the rear cover of the spin tub.

8. The drum type washing machine of claim 7, wherein the first housing section is coupled with the second housing section through fusion welding.

9. A washing machine comprising:

a housing;

a spin tub rotatable by receiving rotational force from a driving motor through a rotating shaft, the spin tub including a spin tub body having an opening formed at a front side thereof to receive laundry and a rear cover provided at a rear side thereof;

a rear balancer coupled to the rear cover of the spin tub, the single rear balancer comprising a first housing section and a second housing section combined together to form an annular shape race and a plurality of balls movably installed in the race; and a shaft flange to uniformly transfer the rotational force to the spin tub, the shaft flange including a hub section to fixedly install the rotating shaft and a plurality of arm sections extending radially outward from the hub section, wherein the rear balancer is disposed in an annular groove formed in the rear cover of the spin tub such that the rear balancer is supported by the rear surface of the annular groove of the rear cover and the front surface of the arm sections of the shaft flange, wherein a supporter is provided at an outer peripheral end portion of the rear cover, wherein an end portion of each respective arm section of the shaft flange is fixed to a protruding part of the rear end portion of the spin tub body and the supporter to secure the first and second housing sections of the rear balancer, the first housing section of the rear balancer has an open side, first and second walls facing each other and a third wall formed between the first and second walls, the second housing section of the rear balancer is adapted to cover the open side of the first housing section, and the rear balancer is disposed in the annular groove such that the second housing section covering the open side of the first housing section is disposed at an innermost portion of the annular groove formed in the rear cover of the spin tub.

10. The drum type washing machine of claim 9, wherein the supporter extends in the rear direction in parallel to the spin tub body, and the depth of the annular groove formed in the rear cover is sized such that, when the rear balancer is sandwiched between the rear cover and the arm sections, a rear surface of the rear balancer does not extend beyond a hollow space region defined by the annular groove, enabling the arm sections to support the rear balancer without having to form recesses in portions of the arm sections that engage the rear balancer.

11. The drum type washing machine of claim 10, wherein the annular groove formed in the rear cover of the spin tub is located at the outer peripheral end portion of the rear cover.

12. The drum type washing machine of claim 11, wherein one of side walls of the annular groove, extending longer than the other side wall, defines the supporter which serves to support the end portion of each respective arm section of the shaft flange.

* * * * *

UNITED STATES PATENT AND TRADEMARK OFFICE

CERTIFICATE OF CORRECTION

PATENT NO. : 7,975,514 B2
APPLICATION NO. : 12/801949
DATED : July 12, 2011
INVENTOR(S) : Ja Young Kim et al.

It is certified that error appears in the above-identified patent and that said Letters Patent is hereby corrected as shown below:

Column 1, Line 9, Delete "Nos. 2006-49497" and insert -- Nos. 2006-49494 --, therefor.

Column 8, Line 4, In Claim 5, delete "balance." and insert -- balancer. --, therefor.

Column 8, Line 6, In Claim 6, delete "sections" and insert -- section --, therefor.

Signed and Sealed this
Fourteenth Day of February, 2012

David J. Kappos

David J. Kappos
*Director of the United States Patent and Trademark Office*